US006561683B1

(12) United States Patent
Jachno

(10) Patent No.: US 6,561,683 B1
(45) Date of Patent: May 13, 2003

(54) PORTABLE LIGHTING DEVICE

(76) Inventor: Alex Jachno, 9301 Encino Ave., Northridge, CA (US) 91325

( * ) Notice: Subject to any disclaimer, the term of this patent is extended or adjusted under 35 U.S.C. 154(b) by 0 days.

(21) Appl. No.: 09/903,938

(22) Filed: Jul. 12, 2001

(51) Int. Cl.[7] ..... F21V 21/14

(52) U.S. Cl. ..... 362/371; 362/370; 362/362; 362/240

(58) Field of Search ..... 362/362, 370, 362/371, 367, 240, 249, 250, 251, 260

(56) References Cited

U.S. PATENT DOCUMENTS 3,835,307 A * 9/1974 Johnson ..... 362/362
3,852,582 A 12/1974 Lowell ..... 240/1.3
4,488,205 A * 12/1984 Quiogue ..... 362/362
5,132,885 A 7/1992 Hocheim et al. ..... 362/217
5,207,747 A 5/1993 Gordin et al. ..... 362/233
5,313,378 A 5/1994 Gordin et al. ..... 362/226
6,079,849 A * 6/2000 Baliozian ..... 362/250
6,168,299 B1 * 1/2001 Yan ..... 362/260
6,224,242 B1 * 5/2001 Giraud et al. ..... 362/371

* cited by examiner

*Primary Examiner*—Laura K. Tso
(74) *Attorney, Agent, or Firm*—Bernard R. Gans, Esq.; Jeffer, Mangels, Butler & Marmaro LLP

(57) ABSTRACT

A portable lighting device including a housing, at least one and preferably a plurality of sockets affixed to the bottom of the housing, and spiral-type fluorescent lights secured in the sockets. The housing includes a bottom and four sides, wherein the bottom and the four sides cooperate to define a housing interior. The spiral-type fluorescent lights are arranged so as to create a virtual single source of light creating one shadow.

13 Claims, 5 Drawing Sheets

PORTABLE LIGHTING DEVICE

FIELD OF THE INVENTION

The present invention relates generally to a portable lighting device, and more particularly to a portable lighting device for use in visual recordings.

BACKGROUND OF THE INVENTION

Proper production is of great importance in photograph, television and motion pictures. There are a variety of lighting systems designed for use in connection with such industries. However, most such lighting systems are heavy and bulky and not easily transportable.

Originally film and television productions were made in studios and, therefore, the weight, size and portability of lighting devices were not of concern. Recently, however, an increasing majority of films are shot on location away from studios and, therefore, need lightweight, small and portable lighting systems which are also versatile and can be easily mounted in convenient and desirable positions or locations.

There have been improved lighting systems which are lighter and more compact than the ones used in film studios. For example, in Lowell, U.S. Pat. No. 3,852,582, a lighting device is disclosed comprising a luminaire, including a reflector mounting on an elongated incandescent tubular lamp with mounting means to support said lighting device. However, the present invention is lighter and more compact and, therefore, more suitable for location filming than the system taught by Lowell. Moreover, the present invention comprises a fluorescent lamp for softer and more efficient lighting than the incandescent lamps used in Lowell. The mounting device utilized in the present invention is highly adaptable to any desired location or position. In prior fluorescent fixtures for visual recordings, the ballast is separable from the fixture. The ballast is plugged in first to the power supply and then the fixture is plugged in to the ballast. The ballast is restricted to only two switches for igniting all or half of the tubes. The fixture is cumbersome and inefficient. When the fixture is damaged it is difficult to determine the problem because the problem may be in the bulb, the ballast or the other components. In the present invention, the light or bulb can be quickly changed to solve the problem. The average life span of the bulbs in the present invention is relatively high, for example, 3000 hours or more.

Traditional fluorescent light fixtures, in order to support the fluorescent tube, utilize a lamp holder attached to the fixture for the needed support. By way of contrast, the present invention uses a locking lamp holder which is supported by the fluorescent lamp itself and is not dependent on any fixture. Furthermore, traditional lamp holders hold the pins of a fluorescent tube by means of a friction fit which is not a firm hold and the lamp frequently disengages from the holder during handling. In contrast, the present invention utilizes a novel spring loaded locking lamp holder which firmly holds the fluorescent lamp without the support of a fixture while providing for electrical contact with the lamp.

Accordingly, it is desirable to provide a fluorescent lighting device that is portable and minimizes shadows.

SUMMARY OF THE PREFERRED EMBODIMENTS

In accordance with a first aspect of the present invention there is provided a portable lighting device including a housing, at least one socket affixed to said bottom of said housing, and at least one fluorescent light secured in said at least one socket. The housing includes a bottom and four sides and the bottom and said four sides cooperate to define a housing interior. In a preferred embodiment, the lighting device includes at least four sockets affixed to the bottom of said housing and at least four fluorescent lights secured in said at least four sockets. The at least four sockets and said at least four fluorescent tubes are arranged so as to create a virtual single source of light creating a single shadow. Preferably, the at least four fluorescent lights include spiral-type tubes.

In accordance with another aspect of the present invention there is provided a method of lighting an object for film production. The method includes the steps of providing a first portable lighting device comprising a housing, a separator disposed in said housing, and at least four spiral-type fluorescent lights having a bulb portion extending through and above a plurality of openings defined in said separator, switching a switch, thereby energizing said spiral-type fluorescent lights, emitting light from said spiral-type fluorescent lights, reflecting a portion of said light off of said separator, and lighting said object. The spiral-type fluorescent lights are arranged so as to create a virtual single source of light. Preferably, the object only casts a single shadow.

In accordance with yet another aspect of the present invention there is provided a light source including a plurality of spiral-type fluorescent lights, and a source of current. The plurality of spiral-type fluorescent lights are energized by said source of current, and are arranged so as to create a virtual single source of light creating a single shadow.

The plurality of lights can be arranged in differed shapes, including a square shape, a circular shape, a linear shape or a plurality of rows and columns.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Generally, the present invention provides a portable lighting device 10 that includes a housing 12 and an arrangement 14 of spiral-type fluorescent lights 16 that are arranged so as to provide a virtual single source of light. It will be appreciated that terms such as "left," "right," "top," "bottom," "inwardly," "outwardly," "front," "inner," "up," and "down" and other positionally descriptive terms used hereinbelow are used merely for ease of description and refer to the orientation of the components as shown in the Figures. It should be understood that any orientation of the elements described herein is within the scope of the present invention. As used herein, a visual recording is any film, video or digital recording or production where lighting is used to light an object.

Figure 1:
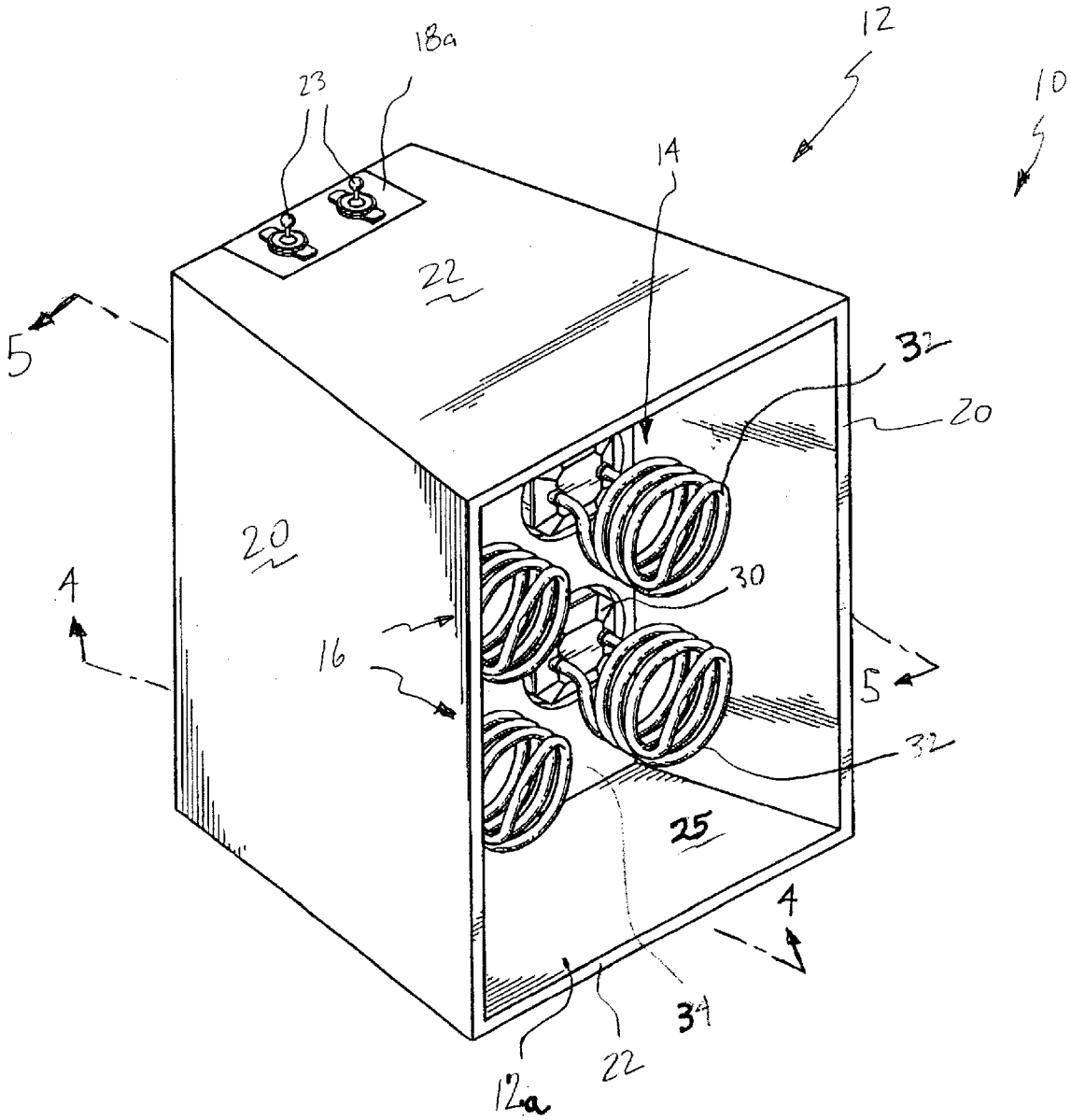
FIG. 1 is a perspective view of a portable lighting device including a housing and an arrangement of spiral-type fluorescent tubes in accordance with a preferred embodiment of the present invention.
Figure 2:
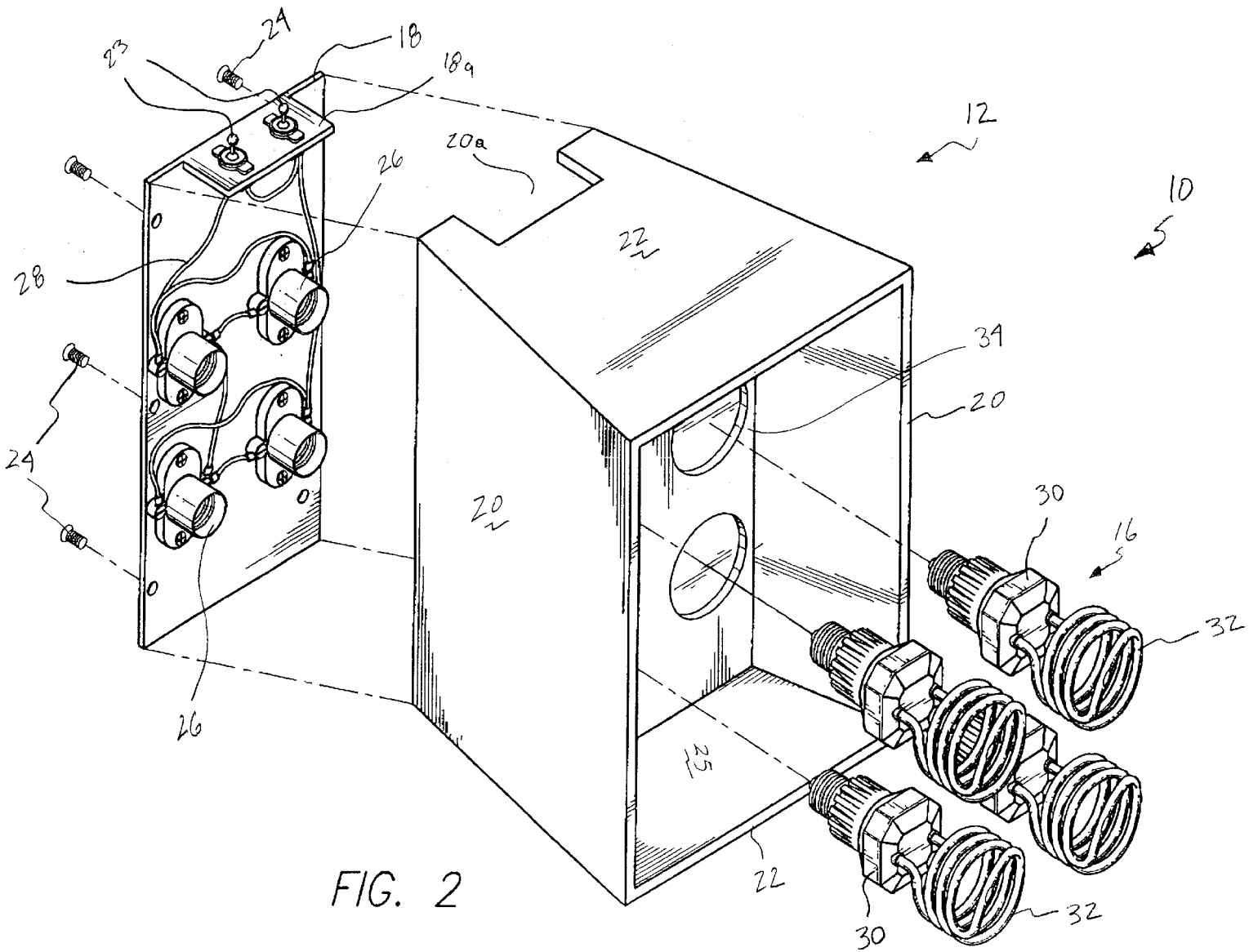
FIG. 2 is an exploded perspective view of the portable lighting device of FIG. 1 showing the base, housing and four spiral-type fluorescent tubes.
Figure 3:
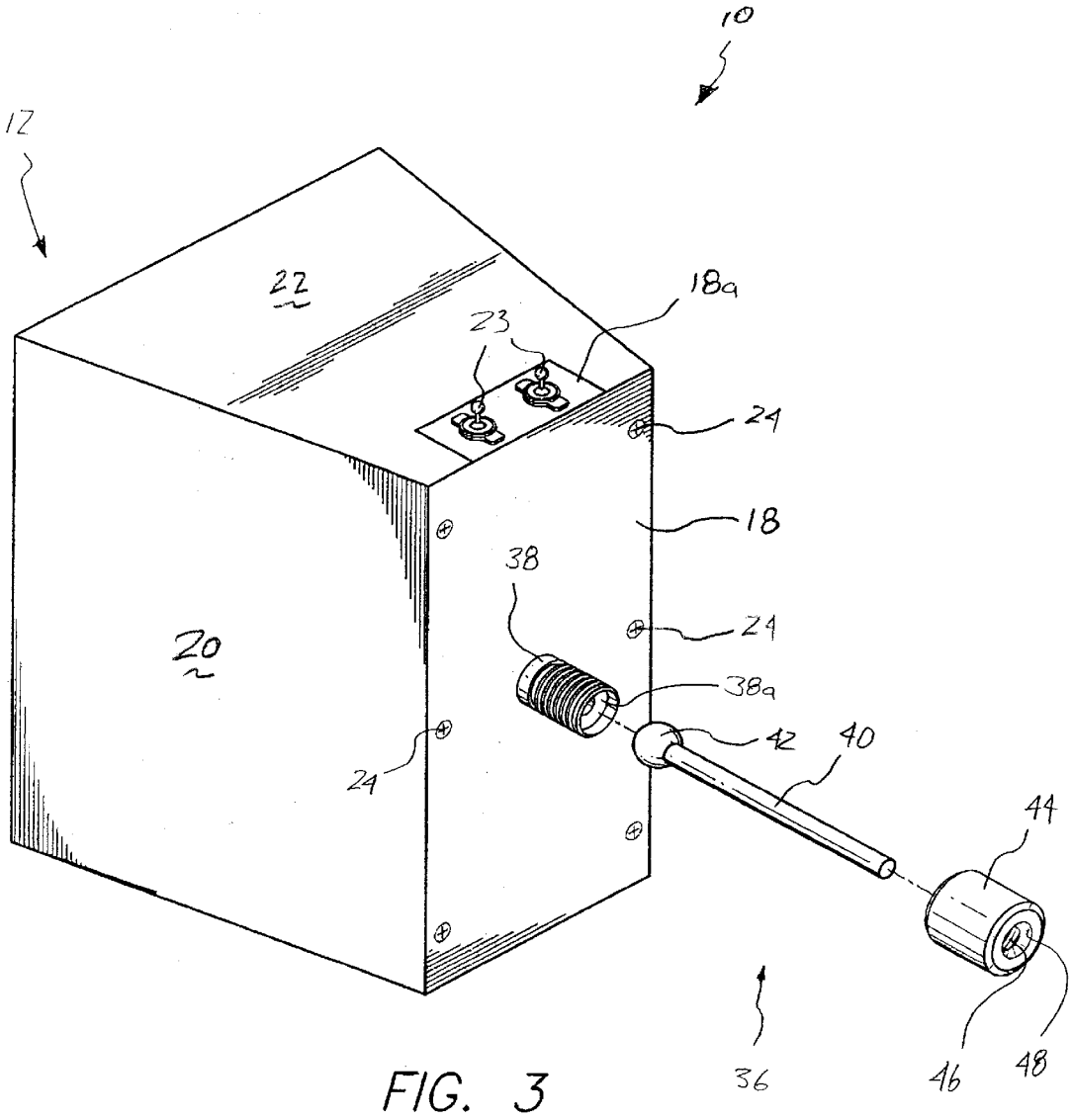
FIG. 3 is a bottom angle perspective view showing the swivel arm exploded away from the housing.

Referring to FIGS. 1–4, a preferred embodiment of a portable lighting device 10 having a plurality of spiral-type fluorescent lights 16 that are arranged so as to provide a virtual single source of light is shown and described. It will be understood that the bulbs can be arranged in any number of orientations, such as linear, circular, square, with a single bulb 16 in the middle and a plurality of other lights 16 surrounding it, or in sets of rows and columns. As best shown in FIG. 2, the housing 12 of the portable lighting device 10 includes a bottom 18, two opposing longs sides 20 and two opposing short sides 22. It will be understood that all of the sides 20, 22 may be the same dimension. The four sides 20, 22 are preferably permanently affixed to one another (by glue, nails, an adhesive or the like), and the bottom 18 is preferably removable from the remainder of the housing, as shown in FIG. 2. A plurality of threaded fasteners 24, such as screws can be used to removably affix the bottom 18 to the four sides 20, 22, thereby defining a housing interior 25. The components of the housing 25 can be made of wood, plastic or a metal.

Figure 5:
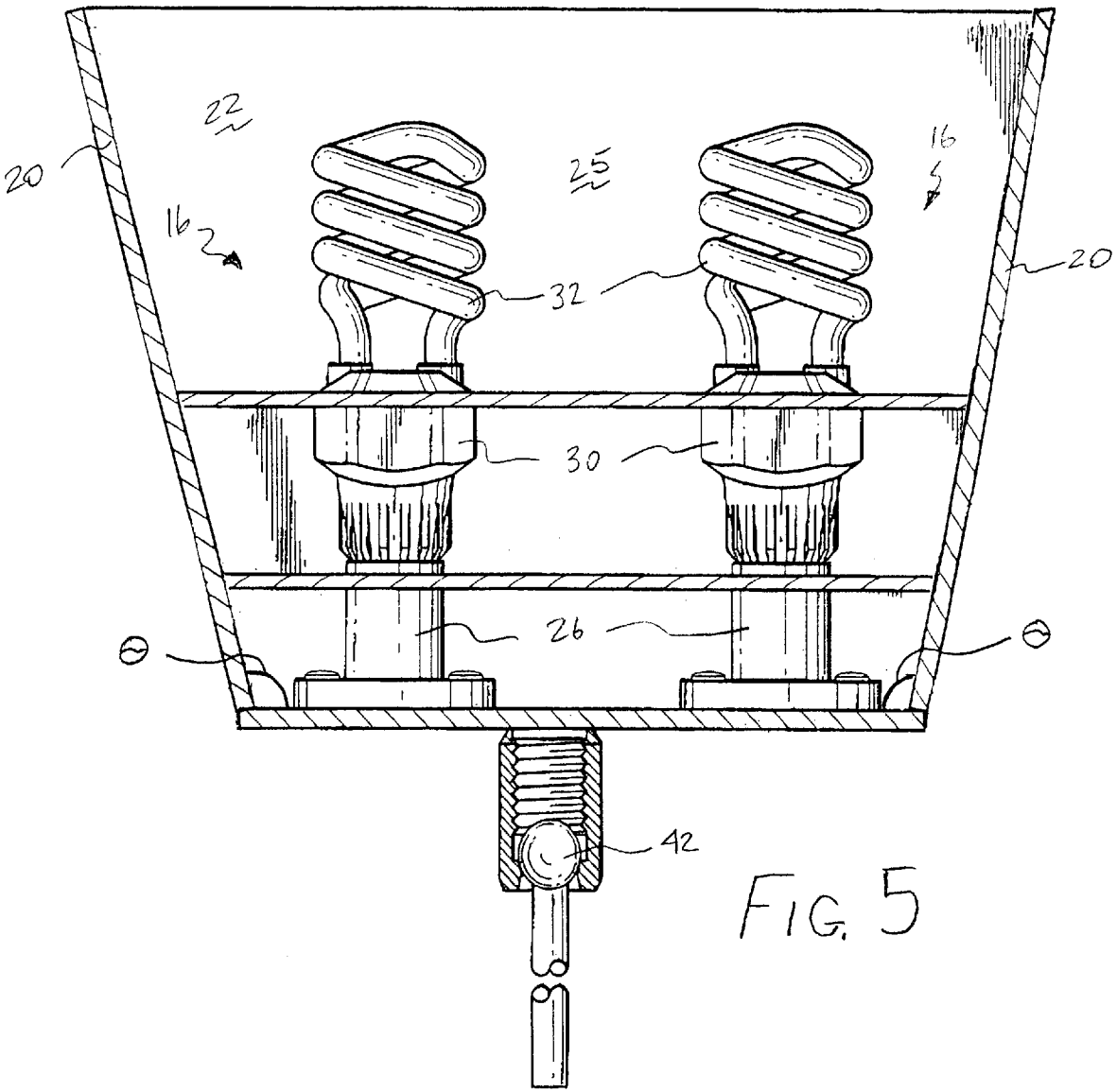
FIG. 5 is a sectional end elevational view of the portable lighting device of FIG. 1 taken along line 5—5 of FIG. 1.

In a preferred embodiment, two of the sides 20, 22 (preferably two opposing sides) are oriented at an obtuse angle θ with respect to the bottom 18 (see FIG. 5). FIG. 5 shows the two long sides 20 being oriented at an obtuse angle θ with respect to the bottom 18, however, this is not a requirement of the present invention. In an alternative embodiment, all four sides 20, 22 may be oriented at an obtuse angle θ with respect to the bottom 18. If any of the sides 20, 22 are oriented at an angle θ with respect to the bottom, the top opening 12*a* of the housing 12 will have a greater area than the area of the bottom 18.

One of the sides 20 includes a cut-out 20*a* therein that cooperates with a tab 18*a* extending upwardly from the bottom 18. At least one switch 23 is mounted on the tab 18*a*.

The bottom 18 includes a plurality of sockets 26 affixed thereto by threaded fasteners 24, glue, other adhesive or the like. The sockets 26 are electrically communicated with one another by a series of wires 28, that also include the switches 23 in the circuit. It will be appreciated by those skilled in the art that the circuit can be set up as desired. For example, the circuit may include a single switch 23 with all of the sockets 26 connected in series so that flipping the switch 23 turns all the lights 16 on or off. Or, the circuit may include two switches 23 for turning on and off separate bulbs as desired. In a four bulb 16 arrangement there are preferably four switches 12 for turning on or off each of the lights 16 individually. This provides the user with more adjustment in the amount of light that the device 10 emits. In an alternative embodiment the device 10 may be provided with a dimmer. The arrangement of the switches 23 and the circuit is not a limitation on the present invention. A cord 27 for providing power to the circuit extends from the bottom 16 of the housing. The lights 16 preferably include a capacitor that acts as a ballast. The capacitor preferably operates the light 16 at approximately 30,000 megahertz, which provides a substantially flicker free light under any lighting set up.

The sockets 26 receive the spiral-type fluorescent lights 16, which extend upwardly therefrom. The spiral-type fluorescent lights 16, include a ballast 30 and a bulb portion 32. Fluorescent bulbs are known for their soft light. The spiral-type tube allows a relatively large amount of tube surface area to be packed into a small volume. A typical fluorescent tube is elongated and cylindrical in shape. This shape is not advantageous for providing a very bright light. In order to provide a higher amount of light a plurality of elongated fluorescent bulbs must be provided. Because of the long shape of the bulbs, if a plurality of them are used, the fixture for holding the bulbs becomes bulky and is not readily portable. For this reason, it is advantageous to use fluorescent lights that include a single socket, such as the spiral-type lights 16 or other tube shapes that extend from a single socket (e.g., unshaped tubes).

In a preferred embodiment of the invention, the lights 16 utilize a special type of phosphor. The film industry uses two types of bulbs, tungsten, which operates at approximately 32000° K and daylight, which operates at approximately 5600° K. It is preferably to have no green in the light since it distorts the skin tone. In most of the bulbs on the market a green spike exists in the phosphor for driving the brightness of the bulbs. However, this is unacceptable in video recordings. Therefore, the lights 16 of the present invention do not have a green spike, and are therefore acceptable for use in video recordings.

Figure 4:
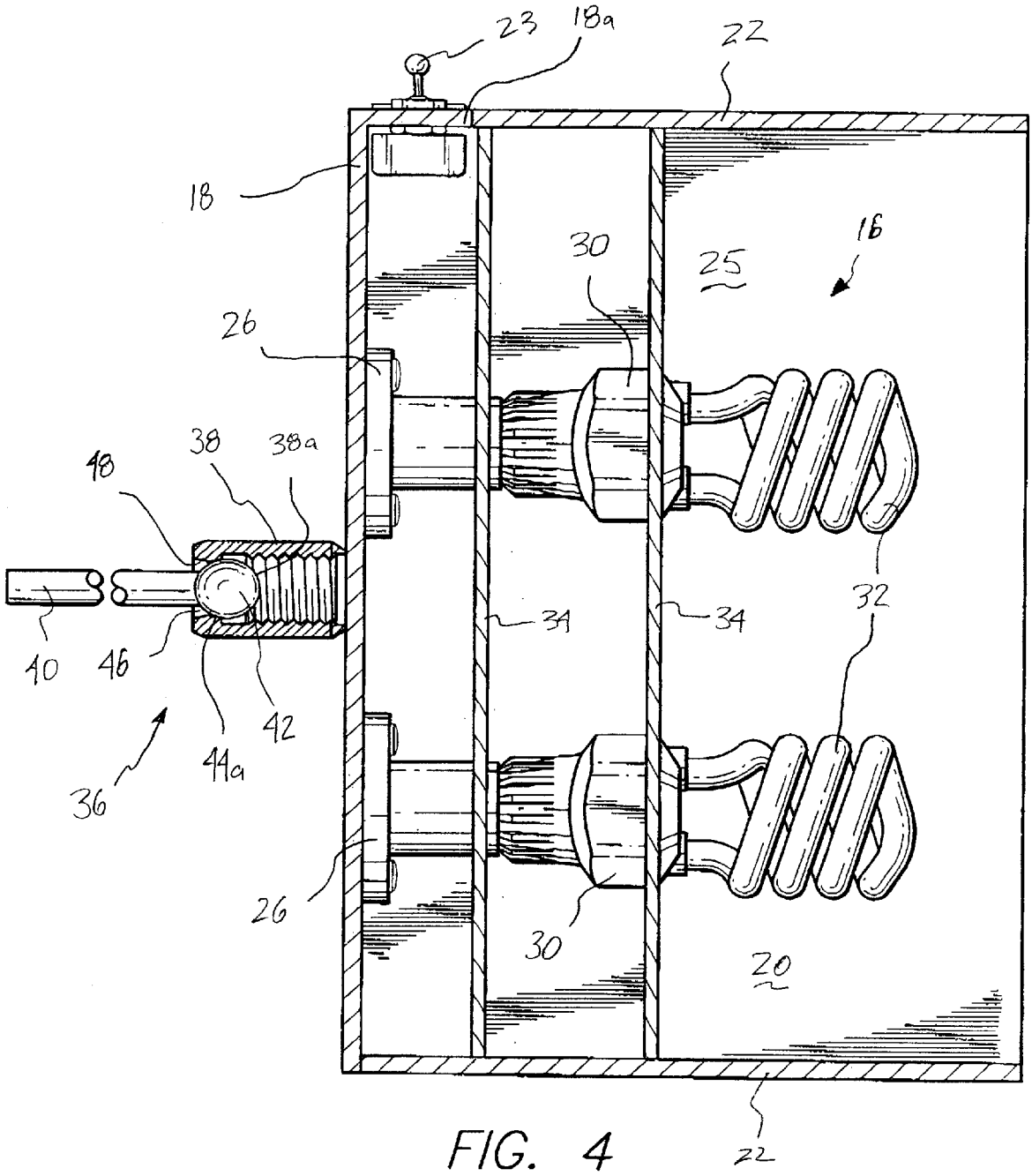
FIG. 4 is a sectional side elevational view of the portable lighting device of FIG. 1 taken along line 4—4 of FIG. 1.

As shown in FIGS. 2, 4 and 5, disposed in the housing interior 25 is a pair of separators 34. Both separators 34 span the area between are affixed to the four sides 20, 22 and have a plurality of openings (corresponding to the number of lights 16) defined therein through which the lights 16 extend. The top separator 34 preferably is reflective (preferably it is white). Accordingly, the top separator 34 aids in reflecting light out of the housing 12. The separator 34 can be a mirror-type reflective surface, or be comprised of a white plastic that does not have any green tones therein. In a preferred embodiment, the entire interior surface of the housing 12 (including the interior surfaces of the sides 20, 22) is reflective. The angle of the sides 20,22 with respect to the bottom 18 (defined above as angle θ) also helps reflect light out of the housing 12.

Extending from the bottom 18 of the housing 12 is a swivel arm 36. The swivel arm 36 includes a threaded member 38 that is secured to and extends downwardly from the bottom 18 of the housing 12. The threaded member 38 is cylindrical in shape and is externally threaded. The threaded member 38 also has a first semi-spherical depression 38*a* defined in a bottom end thereof. The swivel arm 36 also includes an elongated arm portion 40 having a ball 42 on an end thereof, and a cylindrical cap 44 having a threaded interior and a second semi-spherical depression 44*a* defined therein. The cap 44 has an opening 46 defined in the bottom thereof, through which the arm portion 40 extends when the swivel arm 36 is assembled.

To assemble the swivel arm 36, the ball 42 is placed in contact with the first semi-spherical depression 38*a*. Then the cap 44 is slipped onto the arm portion 40 and threaded onto the threaded member 38 until the second semi-spherical depression 44*a* contacts the ball 42. The first and second semi-spherical depressions 38*a*, 44*a* cooperate to define a space in which the ball 42 is captured and can rotate. The ball is rotated 42 by angularly moving the arm portion 40. As shown in FIGS. 4 and 5 opening 46 has a beveled edge 48. The beveled edge 48 defines the outer limits of the movement of arm portion 40. This provides said elongated arm portion with pivotable movement. Alternatively, if the distal end of arm portion 40 is held in place, the rotation of ball 42 allows the housing 12 to pivot. To pivot the ball 42, the cap 44 is loosened slightly, thereby reducing the friction between the ball 42 and the semi-spherical depressions 38*a*, 44*a*. Once the cap 44 is tightened again, the ball 42 is held in place with respect to the semi-spherical depressions 38*a*, 44*a*.

In operation, switches 23 are turned to the on position, thereby closing the circuit and allowing the current in the cord 27 to energize the lights 16, such that they emit light. The light emitted from the lights 16 reflects off of the angled sides 20 or 22 and the separator 34 and is emitted through the opening in the top of the housing 12. Because the close placement of the lights 16, the light emitted from the housing 12 acts as a virtual single source of light, wherein when the light reaches an object a single shadow having soft edges is cast.

Due to the versatility of the present invention, and the provision of different numbers of lights 16 (e.g., 4, 16, 32, etc.), the present invention is very useful in video recordings. Fluorescent light is a very soft light, and therefore when used to light talent or sets in video recordings, the lighting appears shadowless. The present invention can be used as a keylight, filler, backlight, kicker or an eyelight. It can also be mounted on the camera.

The embodiments of the present invention recited herein are intended to be merely exemplary and those skilled in the art will be able to make numerous modifications to them without departing from the spirit of the present invention. For example, one or both of the separators can be eliminated. All such modifications are intended to be within the scope of the present invention as defined by the claims appended hereto.

What is claimed is:

1. A portable lighting device comprising:

a) a housing, said housing including a bottom and four sides, wherein said bottom and said four sides cooperate to define a housing interior, and wherein said housing defines a top opening, and wherein at least two of said sides that are opposed to one another are oriented at an obtuse angle with said bottom, so that said top opening has a larger area than said bottom, and b) at least four sockets affixed to said bottom of said housing, and c) at least four fluorescent lights secured in said at least four sockets, wherein each fluorescent light is associated with four sockets, and wherein said at least four sockets and said at least four fluorescent tubes are arranged so as to create a virtual single source of light creating a single shadow; and wherein said at least four fluorescent lights include spiral-type tubes.

2. The lighting device of claim 1 wherein said four sides include two opposing short sides and two opposing long sides, and wherein said two long sides are the sides that are oriented at an obtuse angle with said bottom.

3. The lighting device of claim 2 wherein said spiral-type fluorescent bulbs each include a ballast located below a bulb portion.

4. The lighting device of claim 3 further comprising a horizontally oriented separator disposed in said housing and attached to said four sides, wherein said separator has at least four openings defined therein, wherein said bulb portion of said spiral-type fluorescent bulbs extends through said at least four openings, and wherein said separator divides said housing interior into a socket portion and a bulb portion.

5. The lighting device of claim 4 further comprising at least one switch mounted on said housing.

6. The lighting device of claim 5 wherein said switch is mounted on said bottom of said housing.

7. The lighting device of claim 6 further comprising a swivel arm extending from said bottom of said housing.

8. The lighting device of claim 7 wherein said swivel arm comprises a threaded member secured to said bottom of said housing, wherein said threaded member has a semi-spherical depression defined in a bottom end thereof, an elongated arm portion having a ball on an end thereof, and a cap having a threaded interior, a semi-spherical depression defined therein, and an opening defined in the bottom thereof, wherein said hole is defined through said semispherical depression, wherein said cap is received on said elongated arm portion and threaded on said threaded portion, and wherein said ball engages said first and second semi-spherical depressions, thereby providing said elongated arm portion with pivotable movement.

9. A method of lighting an object for visual recordings, said method comprising the steps of a) providing a first portable lighting device comprising a housing, a separator disposed in said housing, and at least four spiral-type fluorescent lights having a bulb portion extending through and above a plurality of openings defined in said separator, wherein said spiral-type fluorescent lights are arranged so as to create a virtual single source of light, b) switching a switch, thereby energizing said spiral-type fluorescent lights, c) emitting light from said spiral-type fluorescent lights, d) reflecting a portion of said light off of said separator, and e) lighting said object, wherein said object casts a single shadow.

10. The method of claim 9 wherein said housing comprises a bottom and four sides, wherein said bottom and said four sides cooperate to define a housing interior, wherein at least two of said sides that are opposed to one another are oriented at an obtuse angle with said bottom, and wherein step (d) includes the step of reflecting a portion of said light off of said at least two sides that are oriented at an obtuse angle with said bottom.

11. The method of claim 10 wherein said spiral-type fluorescent lights each include a ballast located below a bulb portion.

12. The method of claim 11 wherein said separator is horizontally oriented, and wherein said separator divides said housing interior into a socket portion and a bulb portion.

13. The method of claim 12 comprising the additional step of providing a second portable lighting device comprising a housing, a separator disposed in said housing, and at least four spiral-type fluorescent lights having a bulb portion extending through and above a plurality of openings defined in said separator, wherein said spiral-type fluorescent lights are arranged so as to create a virtual single source of light, and wherein said first and second portable lighting devices together create a virtual single source of light.

* * * * *